US007364411B2

(12) United States Patent
Tamagawa et al.

(10) Patent No.: US 7,364,411 B2
(45) Date of Patent: Apr. 29, 2008

(54) FAN IMPELLER AND FAN MOTOR

(75) Inventors: Toru Tamagawa, Kyoto (JP); Yusuke Yoshida, Kyoto (JP)

(73) Assignee: Nidec Corporation, Kyoto (JP)

( * ) Notice: Subject to any disclaimer, the term of this patent is extended or adjusted under 35 U.S.C. 154(b) by 679 days.

(21) Appl. No.: 10/708,258

(22) Filed: Feb. 20, 2004

(65) Prior Publication Data

US 2004/0202540 A1 Oct. 14, 2004
US 2006/0013684 A9 Jan. 19, 2006

(30) Foreign Application Priority Data

Apr. 14, 2003 (JP) ..... 2003-108918

(51) Int. Cl.
*F04B 17/00* (2006.01)
*F04B 35/04* (2006.01)
*B63H 1/16* (2006.01)

(52) U.S. Cl. ..... 417/423.1; 417/423.12; 416/187; 416/223 B

(58) Field of Classification Search ..... 417/410.1, 417/423.1, 423.15, 423.12, 423.13, 423.14, 417/424.1, 424.2; 416/185, 186 R, 187, 416/223 B; 415/206
See application file for complete search history.

(56) References Cited

U.S. PATENT DOCUMENTS 4,659,951 A * 4/1987 Angi et al. ..... 310/62
5,570,996 A * 11/1996 Smiley, III ..... 415/53.2
5,741,123 A * 4/1998 Pauly ..... 417/407
5,803,707 A * 9/1998 Schips et al. ..... 415/53.1
5,814,908 A * 9/1998 Muszynski ..... 310/62
5,988,979 A * 11/1999 Wang ..... 416/178

* cited by examiner

*Primary Examiner*—Devon C. Kramer
*Assistant Examiner*—Jessica L Frantz
(74) *Attorney, Agent, or Firm*—Westerman, Hattori, Daniels & Adrian, LLP.

(57) ABSTRACT

Small, high-performance centrifugal fan for cooling portable electronic devices. The centrifugal fan motor employs a cantilever-type impeller constituted by an impeller blade unit that includes a lower endwall portion at axial one end, having a wall surface for breaking the flow of air along the rotational axis, and an opening at the other axial end. The impeller is configured so that the radius r to the outer circumference of the impeller blade unit is smaller than the axial height h of the impeller. When an airflow that enters through the impeller opening is forced out towards outer periphery of the impeller blade unit, windage loss at the wall surface of the lower endwall portion of the impeller is reduced, which realizes high-efficiency cooling performance that complements motor performance.

45 Claims, 9 Drawing Sheets

FAN IMPELLER AND FAN MOTOR

BACKGROUND OF INVENTION

1. Technical Field

The present invention relates to cooling-fan motors and impellers that are used in electronic devices and the like. More specifically, the present invention relates to fan motors that must generate high static pressure and ample airflow volume, and to cantilever-type impellers that are used in such fan motors.

2. Description of the Related Art

FIG. 8 is a plan view of a conventional centrifugal fan motor. FIG. 9 is a vertical cross section along the line $X_1$-$O_1$-$Y_1$-$Z_1$ in FIG. 8. This centrifugal fan motor includes a motor component 104 for generating rotational driving force, an impeller component 101 for generating airflow, and a housing 106. This centrifugal fan motor has a rotational axis $O_1$ shown in FIG. 8.

The impeller component 101 is located around the outer periphery of the motor component 104 and includes a lower end wall 102 and blades 103. The lower end wall 102 is an annular plate member located surrounding the motor component 104 at a lower position in the axial direction, and lies in a plane perpendicular to the rotational axis. The lower ends of the blades 103 are fixed to the surface of the lower end wall 102 at its outer radial margin. The blades 103 are supported only by the lower end wall 102, which structure is called as cantilever structure. When the motor component 104 rotates in the normal direction, the blades 103 generate an airflow in the direction indicated by the arrow $B_1$. In the direction indicated by the arrow $A_1$, an intake airflow through an air inlet 108 is generated by the sucking action of this airflow $B_1$. On the other hand, in the direction indicated by the arrow $C_1$, an ejection airflow is generated by the blowing action of the airflow $B_1$.

In configuring the impeller component 101 of conventional centrifugal fans used for electronic devices and the like, the tendency is to make the blade diameter $2r_1$ greater than the height $h_1$, where $2r_1$ represents the diameter of the blades 103 to their outer perimeter and $h_1$ represents the height of the blades 103 in the axial direction. One of the purposes of adopting this structure is to save space in the axial direction. Another purpose for thus having the blade diameter be greater than the height $h_1$ is to improve air volume and static pressure of the ejection airflow $C_1$ by raising the rotational speed at the periphery of the blades 103. Therefore, in the conventional centrifugal fan having a cantilever impeller for cooling electronic devices and the like, the impeller has a low-profile configuration in which the relationship $h_1 \leqq 2r_1$ holds.

In this conventional centrifugal fan, the intake airflow $A_1$ pushes on the airflow $B_1$ as indicated in FIG. 9, and the airflow $B_1$ strikes downward on the lower end wall 102 because of the shorter height $h_1$ of the blades, which results in a large windage loss between the downward airflow and the wall surface of the lower end wall 102. This is why, in considering the distribution of wind speed measured at several observation locations corresponding to points along the rotational axis of the impeller component 101, the wind speed of the intake airflow within the impeller tends to be maximal at the upper surface of the lower end wall 102 of the impeller. The windage loss on the wall surface can decrease airflow volume from the fan and lower the cooling efficiency below the inherent performance of the fan motor.

Meanwhile, electronic devices recently are being made smaller and smaller so as to be suitable for carrying, as is the case with cellular phones, mobile personal computers, and other devices that call for being downsized further. At the same time, integration of electronic circuits has been enhanced and circuit processing speeds have been increased, which has led to a tendency for the total amount of heat produced by LSI chips and embedded electronic circuitry to increase. Therefore, there is a need to realize a fan motor having not only a smaller size but also higher cooling efficiency.

SUMMARY OF INVENTION

An object of the present invention is to realize a fan motor that can be used for ultra-compact devices such as cellular phones, and that is ultrasmall in size and has high cooling efficiency, as well as to realize an impeller that is used for a fan motor of this sort. Another object of the present invention is to make available a fan motor capable of realizing maximum cooling efficiency with minimum air-inlet area, as well as to make available an impeller that is used for such a fan motor.

According to the present invention, a cantilever-type fan impeller comprises: a rotational force transmission portion for receiving driving force from a fan motor component; a lower endwall portion fixed in association with the rotational force transmission portion, for structuring a wall surface that is perpendicular to the impeller rotational axis; and an impeller blade unit having plural blades, disposed outer-marginally on the wall surface of the lower endwall portion and extending along rotational axis. When the fan impeller rotates, an airflow along the rotational axis, from the opening in the upper end of the impeller blade unit towards the wall surface, is generated. The relationships $2r \leqq h$ and $r \leqq 12.5$ mm are satisfied wherein 2r represents the diameter to outer circumference of the impeller blade unit and h represents the axial height of the impeller blade unit. In this fan impeller, when driving force is applied from the motor component to the rotational force transmission portion, the lower endwall portion and the impeller blade unit rotate along with the rotation force transmission portion. Then, an airflow along the rotational axis, from the opening in the upper end of the impeller blade unit towards the wall surface that is perpendicular to the axis, is generated. Next, the airflow hits the wall surface and changes direction. Since $2r \leqq h$, windage loss at the wall surface of the lower endwall portion is reduced compared with conventional centrifugal fans, so that cooling efficiency is improved.

Further according to the present invention, a fan motor having the cantilever-type impeller satisfies the relationship $k \leqq 100$ mm, wherein k represents the total axial length of the motor and the impeller. In addition, it is preferable that $k \leqq 70$ mm. This enables the fan impeller to be embedded in portable electronic devices or other small electronic devices.

In another aspect of the invention, the fan motor having the cantilever-type impeller satisfies the relationship $n \geqq 5000$ rpm, more preferably, $n \geqq 10{,}000$ rpm, wherein n represents the rotational speed of the motor. A fan motor thus according to the present invention, having a fan impeller that is extensive along the rotational axis, can realize high static pressure and high-efficiency cooling performance when operated at the high speeds just noted.

In a yet another aspect of the present invention, both the cantilever-type impeller alone or as employed in fan motors as just described may be made either entirely or partially of a liquid crystal polymer, a carbon-fiber-reinforced liquid crystal polymer, a glass-fiber-reinforced liquid crystal polymer, a carbon-fiber and glass-fiber-reinforced liquid crystal polymer, soft iron, stainless steel, aluminum, or ceramic. This contributes toward reducing the weight of and downsizing the fan impeller, while ensuring sufficient stiffness and airflow-generation performance in the impeller.

In addition according to the invention, in a fan motor having a cantilever-type impeller, the motor component includes a rotary section and a stationary section, and a pair of axially disposed bearing units—being slide bearings or fluid dynamic pressure bearings—for rotatably supporting the rotary section against the stationary section, and the relationship 0.5 m<h holds, wherein m represents the distance between the two axial ends of the bearing units. Having h on par with or greater than 0.5 m contributes to keeping losses (windage losses) occurring before the airflow hits the wall surface of the lower endwall portion under control. A high-efficiency fan motor can be realized as a result. Further according to the invention, h more preferably is much greater than m. Because the length of the impeller is much longer in that case, windage losses arising before the airflow hits the wall surface of the lower endwall portion are further kept under control. A configuration thus satisfying the relationship m<h suppresses windage loss on the lower endwall portion. And wherein the relationship 1.5 m<h is satisfied, windage losses on the lower endwall portion are kept under control all the more.

Still further according to the present invention, the relationship m>h/5 is satisfied. Increasing m to greater than h/5, wherein m corresponds to the so-called bearing span, makes it possible on the motor-component end to stabilize rotation of the cantilever-type impeller more than is the case with a fan motor configuration in which the bearing span is less than h/5. This contributes to improved rotational stability of the fan impeller and to minimization of losses due to vibration in the end portion of the cantilever-type impeller, so that a high-efficiency fan motor can be realized. It is further preferable according to the invention that m be larger than h/4, and more preferable still that m be larger than h/3. The bearing span is thus further increased to retain the cantilever-type impeller the more securely in rotation.

A further aspect of the present invention is a fan motor having a cantilever-type impeller, wherein the motor component includes a rotary section and a stationary section, and a pair of axially separated bearing units for rotatably supporting the rotary section against the stationary section, the stationary section includes a stator, and the pair of bearing units is disposed axially sandwiching the stator. Disposing the bearing units of the pair along the motor rotational axis one on each side of the stator allows the axial bearing span to be maximized. This contributes to stabilizing impeller rotational fluctuations that are a load on the motor, so that a high efficiency fan motor with little loss due to vibrations can be realized.

A still further aspect of the invention is a fan motor having a cantilever-type impeller, wherein the motor component includes a rotary section and a stationary section, and is furnished with a slide bearing section or a fluid-dynamic-pressure bearing section for rotatably supporting the rotary section against the stationary section; the stationary section includes a stator; and the slide bearing section or the fluid-dynamic-pressure bearing section has a structure in which each end along the rotational axis is disposed in a position axially beyond either axial end of the stator. This structure allows the bearing span along the rotational axis of the motor to be maximized. This contributes to stabilizing impeller rotational fluctuations that are a load on the motor, so that a high efficiency fan motor with little loss due to vibrations can be realized.

As is evident from the comparison of structures discussed above, a fan impeller and a fan motor of the present invention have an impeller that is axially longer than conventional centrifugal fans, and the impeller is rotated at higher speed. Accordingly, windage and other losses at the wall surface of the lower endwall portion are reduced, enabling the realization of a fan motor having higher static pressure than is conventional. This makes it possible to cool high-density electronic devices and compact electronic devices with efficiency several times high than is conventional.

From the following detailed description in conjunction with the accompanying drawings, the foregoing and other objects, features, aspects and advantages of the present invention will become readily apparent to those skilled in the art.

DETAILED DESCRIPTION

Figure 1:
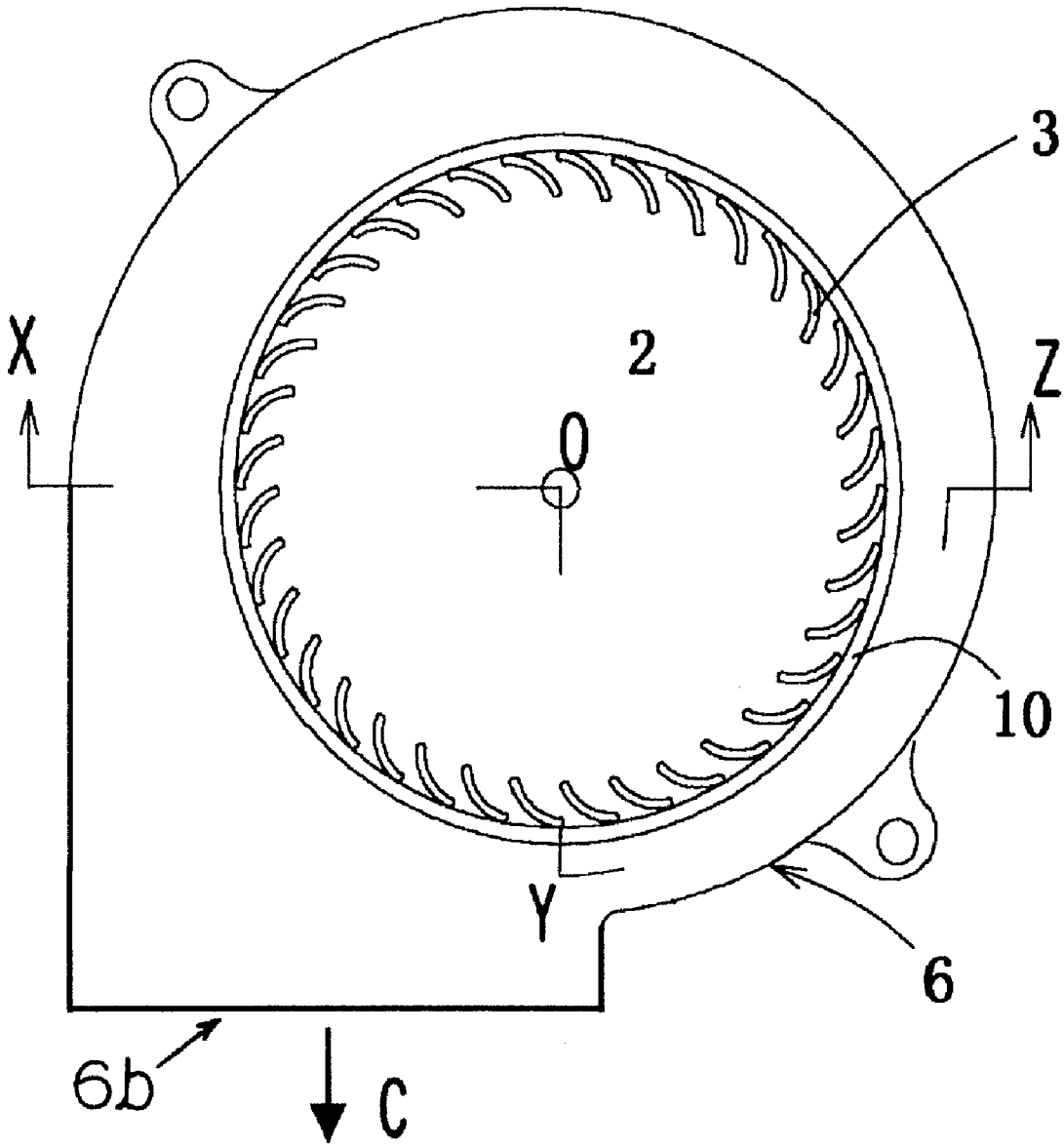
FIG. 1 is a plan view of a centrifugal fan motor according to an embodiment of the present invention.
Figure 2:
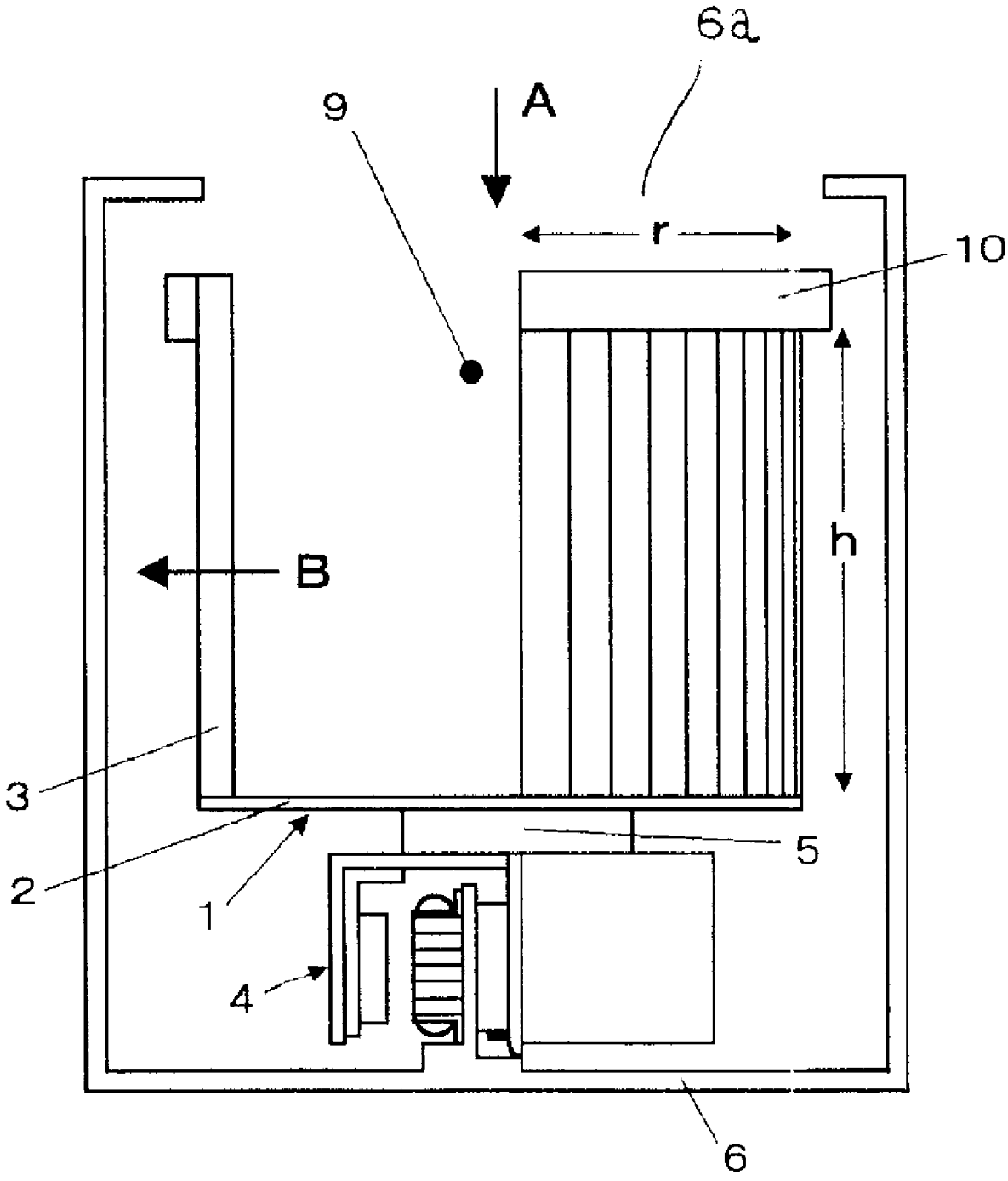
FIG. 2 is a vertical cross section taken along the line X-O-Y-Z in FIG. 1.

Reference is made to FIG. 1, which is a plan view of a centrifugal fan motor according to an embodiment of the present invention, and to FIG. 2, which is a vertical cross section, taken along the line X-O-Y-Z in FIG. 1. The vertical direction in FIG. 2 corresponds to the orientation of the rotational axis of the centrifugal fan motor. Though upper and lower sides are defined according to FIG. 2 in the following explanation, the definitions are for convenience of explanation and are not meant to imply restrictions on the actual attachment posture of the fan motor.

This fan motor includes an impeller component 1, a motor component 4 and a housing 6. The impeller component 1 and the motor component 4 are disposed axially stacked and connected to each other, and these interconnected components are contained in the housing 6. The rotational axis of this centrifugal fan motor is indicated by O in FIG. 1.

Figure 3:
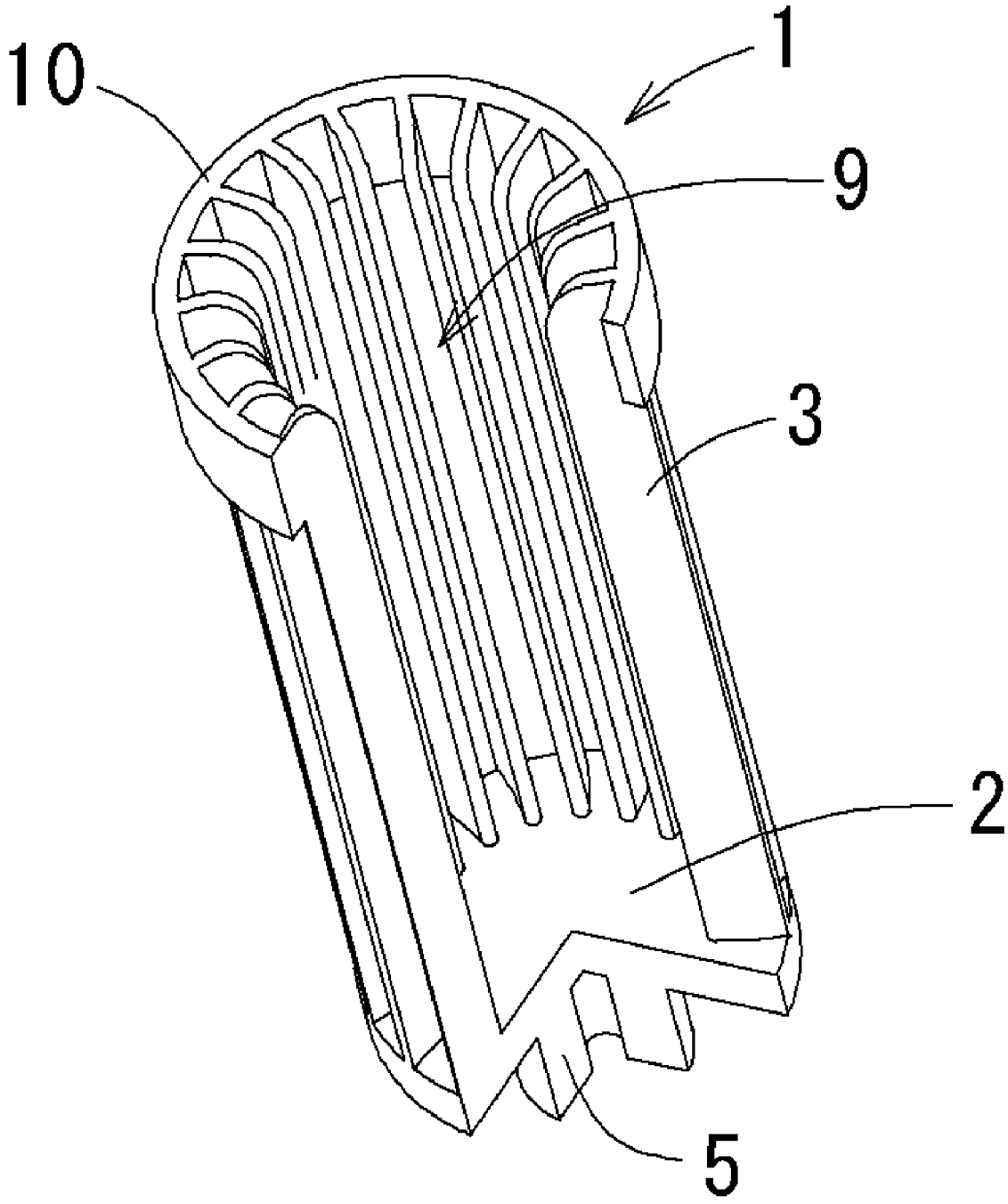
FIG. 3 is an oblique view of an impeller component of the centrifugal fan illustrated in FIG. 1, shown partially cut away as sectioned for FIG. 2.

Reference is now made to FIG. 3, which shows the impeller component 1 in a partially cut away oblique view as sectioned for FIG. 2. As will be understood from FIG. 3, the impeller component 1 is an impeller of the cantilever type used for centrifugal fan motors. The impeller component 1 includes a rotational force transmission portion 5 for receiving drive force from the motor component 4, a lower endwall portion 2 fixed thereto, and an impeller blade unit 3 having plural blades, each of the blades being fixed at its lower end to the outer margin of the wall surface of the lower endwall portion 2 and each extending along the rotational axis to its upper end. Each blade of the impeller blade unit 3 is cantilevered, that is, the lower end thereof is fixed to the lower endwall portion 2 while the upper end thereof is not supported by anything. In other words, the "lower end" of the impeller blade unit 3 means a fixed end while the "upper end" of the same means a free end. An opening 9 that is a circular space is defined by the upper ends of the plural blades of the impeller blade unit 3. When the impeller component 1 rotates, an airflow is generated streaming along the rotational axis through the opening 9 in the upper end of the impeller blade unit 3 and towards the upper surface of the lower endwall portion 2. The lower endwall portion 2 is a disk-like member having a surface that faces the rotational axis in this embodiment. The upper surface of the lower endwall portion 2 forms a lower wall surface of the impeller blade unit 3 and functions to stop the airflow along the axial direction. As shown in FIG. 2, the upper rim portion of the impeller blade unit 3 is fitted with a ring connection portion 10 holding the blades together for reinforcement. The housing 6 encompasses the circumference of the impeller component 1 and the circumference of the lower end of the motor component 4. In the upper portion of the housing 6 is an air inlet 6*a*, and in the side portion thereof is an air outlet 6*b*. In addition, the base of the motor component 4 is fixed to or formed integrally with the upper surface of the bottom of the housing 6.

The rotational force transmission portion 5 is connected to a rotor of the motor component 4, and the plural blades of the impeller blade unit 3 extending along the axial direction generate an airflow B in response to rotation of the motor, thereby realizing a blowing function. This airflow B induces an intake airflow A through the air inlet 6*a* of the housing 6 and the impeller opening 9, and consequently airflows A, B and C are generated, whereby the airflow C is directed from the air outlet 6*b* of the housing 6 onto a cooling target (not illustrated).

Figure 8:
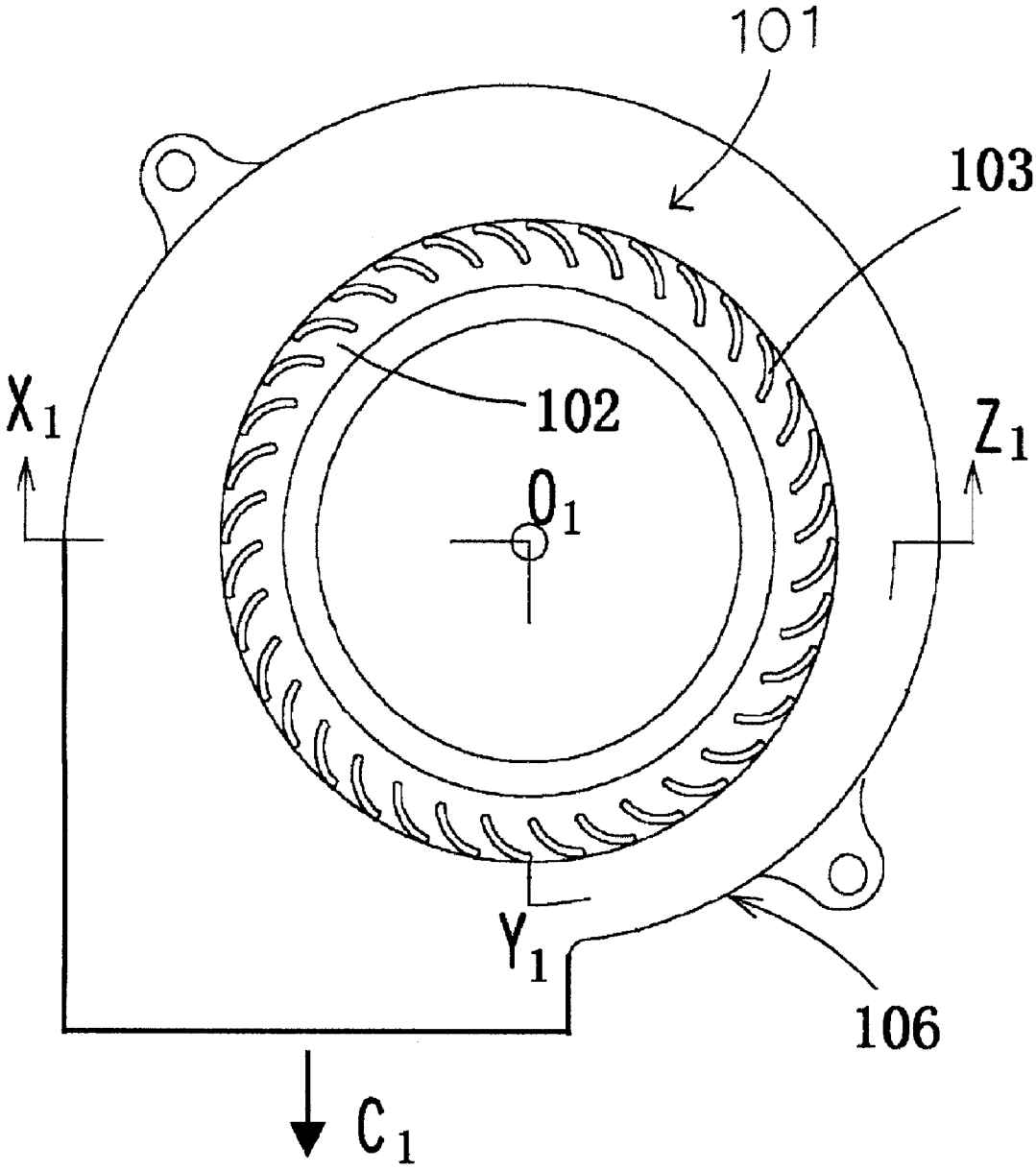
Prior Art FIG. 8
FIG. 8 is a plan view of a conventional centrifugal fan motor.

In the centrifugal fan motor according to this aspect of the present invention, compared with the conventional centrifugal fan motor represented in FIG. 8, the diameter 2r of the impeller blade unit 3 to its outer circumference is less than the height h of the impeller component 1 (that is, the length of the impeller blade unit 3 along the axial direction that can generate the ejection airflow; more specifically, the distance along the axial direction between the upper surface of the lower endwall portion 2 and the undersurface of the ring connection portion 10). In addition, the fan motor according to this aspect of the invention can cool a portable electronic device or a compact device efficiently at high static pressure, while the motor configuration satisfies the relationship $r \leqq 12.5$ mm.

If the height h of the impeller component 1 in the axis direction is greater than the diameter 2r of the impeller blade unit 3 to its outer circumference, the intake airflow A generated by the rotational airflow B along the circumference direction by the impeller blade unit 3 transitions to the airflow B smoothly before reaching the lower endwall portion 2 of the impeller component 1, reducing the wind speed at the upper surface of the lower endwall portion 2.

In terms of the distribution of airflow speed along the rotational axis of the impeller component 1, as h becomes taller, the point of maximum speed in the airflow as observed at several locations corresponding to points along the axis should move to a point inside the impeller, with the airflow speed at the upper surface of the lower endwall portion 2 decreasing from that of the conventional centrifugal fan. As a result, windage loss on the upper surface of the lower endwall portion 2 can be expected to decrease. Here, the observation point along the axis of the impeller component 1 that is the maximum wind-speed point in the airflow speed distribution should be noted.

In a conventional centrifugal fan for cooling an electronic device, the maximum wind-speed point among observation points along the axis should not appear at a point inside the impeller; instead, the airflow speed should be maximum on the upper surface of the lower endwall portion 2. In contrast, if the following relationship (1) between the diameter 2r to the outer circumference of the impeller blade unit 3, and the height h of the impeller component 1, is satisfied and the rotation speed of the fan is 5000 rpm or higher, the maximum wind-speed point along the axis should appear inside the impeller, so that the airflow-speed maximum will no longer be on the upper surface of the lower endwall portion 2.

As a result, compared with the conventional centrifugal fan, the windage loss on the upper surface of the lower endwall portion 2 is reduced. Thus, a fan having high static pressure and high cooling efficiency compared with conventional centrifugal fans can be realized. In particular, a fan in which the relationship $r \leqq 12.5$ mm is satisfied will realize high cooling efficiency.

One of the factors related to whether or not the maximum wind-speed point along the axis appears inside the impeller—and to where it appears along the axis inside the impeller—is the shape of the impeller component. The present invention definitively sets forth that if the relationship defined by the following expressions (2) and (3) using a parameter a is satisfied between the area of intake airflow into the impeller component 1 (that is, the area of the cross section perpendicular to the axis at the upper-end portion of the impeller component, i.e., $\pi r^2$), and the area of ejection airflow of air blown by the impeller blade unit 3 (that is, the effective cylindrical area of the impelled blade unit 3 of the impeller component that contributes to blowing of the airflow, i.e., $2\pi rh$), the airflow speed maximum will not be on the upper surface of the lower endwall portion 2, whereby the impeller produces efficient airflow.

$$2\pi rh = \alpha\pi r^2 \tag{2}$$

$$4 \leqq \alpha \leqq 40 \tag{3}$$

Thus, a fan motor having a smaller windage loss and higher efficiency than conventional centrifugal fans can be realized.

Though the airflow speed maximum should not appear on the upper surface of the lower endwall portion 2 even if $\alpha > 40$, cantilever-type impellers prove to be over-extensive axially the as a becomes larger than that, making it is difficult to obtain stable impeller rotation, and as a result loss due to impeller vibration or other factors may increase, and the cooling efficiency of the fan may decrease.

In certain practical applications, it is more preferable that the following relationship (4) is satisfied.

$$5 \leqq \alpha 35 \tag{4}$$

If $5 \leqq \alpha$, the maximum wind-speed point should appear along the axis inside the impeller and at a position relatively distant from the lower endwall portion 2, producing a correspondingly sufficient drop in the airflow speed at the upper surface of the lower endwall portion 2. Therefore, the windage loss at the upper surface of the lower endwall portion 2 can be reduced further so that a centrifugal fan having higher efficiency can be realized.

Since $\alpha \leqq 35$ on the other end of the range, the impeller is not over-extensive axially, so that stable rotation of cantilever-type impellers can be realized. Thus, impeller vibration is further reduced, so that a fan motor having better cooling efficiency can be realized.

The above-explained comparison between the intake airflow area of the impeller component 1 and the ejection airflow area of the air blown by the impeller blade unit 3 can be applied to the case where the circular area of the impeller $2\pi rh$ is large enough relative to the total sum dhZ (where Z is the number of blades in the impeller blade unit) of the area of the cylindrical cross sections dh (where d is the blade thickness) around the axis of the impeller blade unit 3 that the latter can be neglected. However, if the diameter 2r to the outer circumference of the impeller blade unit is reduced such that the total sum of the area of the cylindrical cross sections of the impeller blade unit 3 cannot be neglected, a gap ratio $\epsilon$ defined by the following equation (5) must be taken into consideration.

$$\epsilon=(2\pi r-Zd)/2\pi r \tag{5}$$

In this case of the present invention, the ejection airflow effective area of the air blown by the impeller blade unit 3 becomes $2\pi r\epsilon h$. Here it is definitively set forth that if the relationship defined by the following expressions (6) and (7) using a parameter $\beta$ is satisfied, the airflow speed will not have the maximum value on the upper surface of the lower endwall portion 2, so that higher cooling efficiency with higher static pressure can be obtained.

$$2\pi r\epsilon h=\beta\pi r^2 \tag{6}$$

$$3 \leqq B \leqq 30 \tag{7}$$

Thus, a fan motor having a smaller windage loss and higher efficiency than the conventional centrifugal fan can be realized.

The reason for $3 \leqq \beta$ is that if $\beta$ has a value less than three, the airflow speed maximum may be at the upper surface of the lower endwall portion 2, and a windage loss similar to conventional centrifugal fans may be produced at the upper surface of the lower endwall portion 2, leading to decreased cooling efficiency of the fan. On the other hand, the reason why $\beta \leqq 30$ is that if $\beta$ has a value greater than 30, the impeller may become axially over-extensive in accordance with the larger value of $\beta$, making it difficult to obtain stable rotation of a cantilever-type impeller, even though the airflow speed does not have its maximum value on the upper surface of the lower endwall portion 2. In certain practical applications, the value of $\beta$ thus is preferably 30 or smaller.

OTHER EMBODIMENTS

Figure 4:
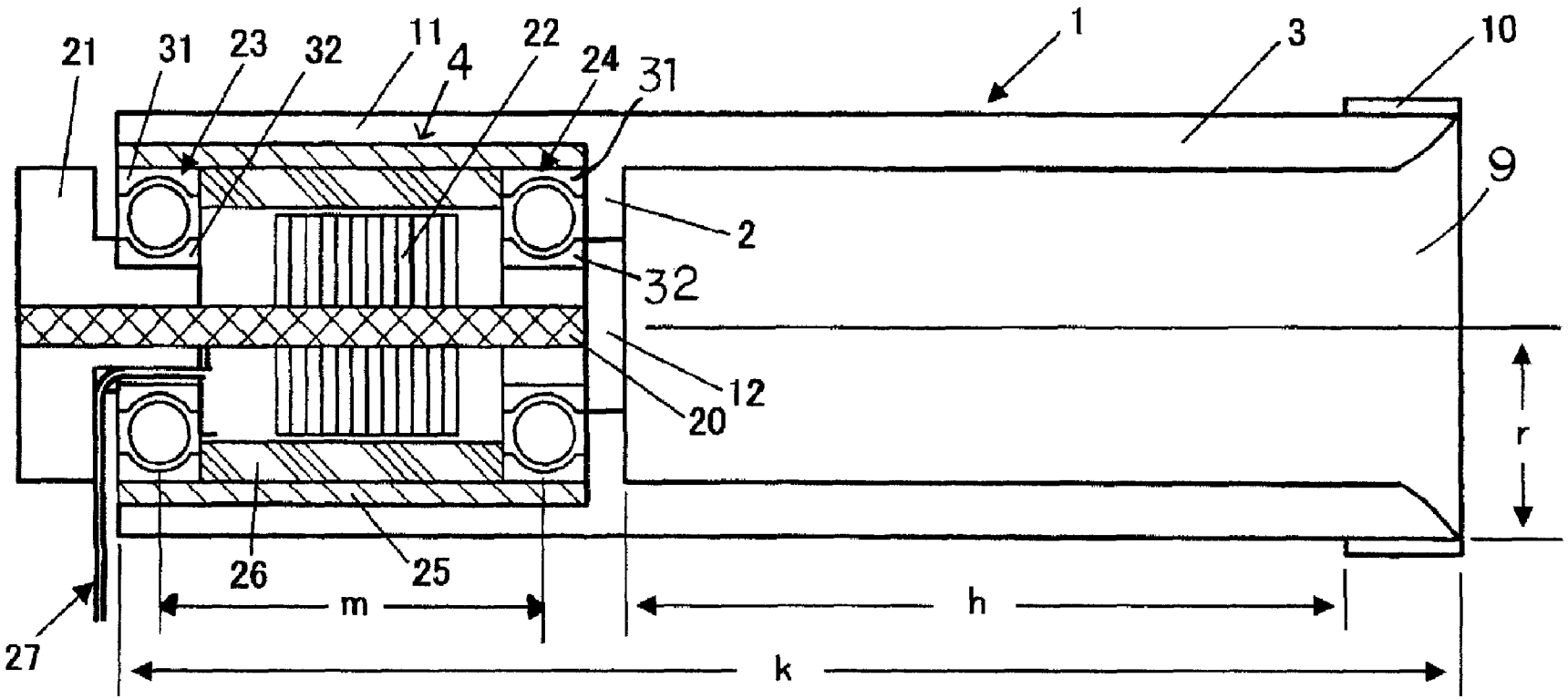
FIG. 4 is a vertical cross section of a fan motor according to another embodiment of the present invention.

Next, another embodiment demonstrating further effects of the present invention will be explained with reference to FIG. 4. FIG. 4 shows a cross section, taken along a plane including the rotational axis, of a fan motor, and in the fan motor the impeller component 1 and the motor component 4 are structured integrally. For the most part, the fan motor has a structure similar to that shown in FIG. 2, and to refer to elements having the same function the same reference numerals are also used in FIG. 4. The horizontal direction in FIG. 4 corresponds to the rotational axis direction of a centrifugal fan motor. Though the right side in FIG. 4 is referred to as the "upper side" and the left side in FIG. 4 is referred to as the "lower side" in the following explanation, these references are for convenience of explanation and are not meant to imply restrictions on the actual attachment posture of the fan motor.

This fan motor includes an impeller component 1 and a motor component 4. The impeller component 1 and the motor component 4 are disposed axially stacked and connected to each other.

The impeller component 1 is an impeller of the cantilever type used for centrifugal fan motors. The impeller component 1 includes: a drive force transmission portion 11 for receiving drive force from the motor component 4; a rotor-side lower endwall portion 2, fixed to the transmission portion 11, and a stationary-side lower endwall portion 12; and an impeller blade unit 3 having plural blades, each of the blades being fixed at its lower end to the outer margin of the wall surface of the lower endwall portion 2 and each extending along the rotational axis to its upper end. The impeller blade unit 3 is cantilevered, that is, the lower end thereof is fixed to the lower endwall portion 2 while the upper end thereof is not supported by anything. When the impeller component 1 rotates, an airflow is generated streaming along the rotational axis through the opening 9 in the upper end of the impeller blade unit 3 and towards the upper surface of the lower endwall portions 2 and 12. The lower endwall portion 2 is an annular section belonging to the rotor side, while the lower endwall portion 12 is a disk-like section disposed inside the lower endwall portion 2 and belonging to the stationary side. Thus, the two together constitute a disk-like shape. The impeller component 1 further includes a ring connection portion 10 for linking the blades of the impeller blade unit 3 at their upper end portions. The drive force transmission portion 11 in this embodiment is an extension, extending from the lower endwall portion 2 along the motor component 4; more specifically, the transmission portion 11 forms an extending cylindrical section that encloses the entire outer-side face of the motor component 4. In this way, the drive force transmission portion 11 of the impeller component 1 has a larger area for contacting a rotor holder 25 (a portion of the motor component 4 that is supported by a pair of bearings 23 and 24) than conventional fan motors, so that rotational stability of impeller component 1 is further improved and vibrational losses can be reduced. In other words, efficiency of the fan motor is further improved. Furthermore, the impeller blade unit 3, the lower endwall portion 2, and the drive force transmission portion 11 are formed integrally to constitute the impeller component 1 having a single unit structure.

The motor component 4 has a so-called outer rotor structure in which a rotary section thereof is located circumferentially around an inner stator 22. The rotary section of the motor component 4 includes the rotor holder 25 and a rotor magnet 26. The rotor magnet 26 contacts and is fixed to the inner surface of the rotor holder 25. The rotor holder 25 constitutes part of a magnetic circuit as a yoke made of a magnetic material, and also works as a reinforcing member in connecting with the driving force transmission portion 11. The rotor holder 25 is extensive along the rotational axis and is longer than the rotor magnet 26. Both axial ends thereof extend axially longer than both the ends of the rotor magnet 26 do. On the other hand, the stationary portion of the motor component 4 includes a shaft 20, a bracket 21 and the stator 22, which is located to the inside of the rotor magnet 26. Along its lower end the shaft 20 is fixed to the bracket 21. The stator 22 is fixed to the shaft 20 and radially opposes the rotor magnet 26 across a gap; the two components form the magnetic circuit. A coil of the stator 22 is connected to a current supplying wire 27 outside the motor component 4. As a bearing structure for supporting the rotary section of the motor component 4 in a rotatable manner around the stationary portion, a pair of bearings (ball bearings) 23 and 24 is provided in locations along the rotational axis. The bearing 23 is a member for supporting the lower end of the rotary section, and an outer race 31 thereof is fixed to the lower-end inner surface of the rotor holder 25, while an inner race 32 thereof is fixed to a boss protruding from the middle of the bracket 21. In addition, the upper surface of the outer race 31 is fixed to the lower surface of the rotor magnet 26. The bearing 24 is a member for rotatably supporting the upper end of the rotary section, and an outer race 31 thereof is fixed to the upper-end inner surface of the rotor holder 25, while an inner race 32 thereof is fixed to the upper-end portion of the shaft 20. Furthermore, the lower surface of the outer race 31 is fixed to the upper end surface of the rotor magnet 26. The bearings 23 and 24 as a pair are disposed thus flanking the stator 22 vertically so as to secure a wide span between them—wherein the bearing span is represented as m in FIG. 4—so that the rotary section including the cantilever impeller can be supported stably. More specifically, the distance between the bearings 23 and 24 can be equal to the axial length of the motor, or a length close to the motor axial length. Thus, a maximal bearing span m can be secured, and rotational vibration of the rotary section including the impeller component 1 can be minimized. In addition, since the outer races 31 of the bearings 23 and 24 are fixed to the rotor holder 25 and the inner races 32 are fixed to the shaft portion (more specifically, to the boss in the bracket 21 and to the shaft 20 upper end), the rotary section can be supported stably.

Next, a link structure between the motor component 4 and the impeller component 1 will be explained. The drive force transmission portion 11 of the impeller component 1 is configured so as to cover the entire outer surface of the rotor holder 25 of the motor component 4. The upper end surface of the rotor holder 25 and the upper surface of the outer race 31 of the bearing 24 are fixed to the lower surface of the lower endwall portion 2. In this way, the motor-component-side wall face of the lower endwall portion 2 of the impeller component 1, as well as components linked thereto, is fixed directly to the bearing 24, so that the fan motor is axially short. Alternatively the motor-component-side wall face of the lower-endwall portion 2 of the impeller component 1 as well as any components linked thereto can be fixed to the bearing 24 via a bearing holder.

In addition, as explained above, the lower endwall portions 2 and 12 of the impeller component 1 function not only to stop the airflow axially in the impeller component 1 but also function as a wall of the motor component 4. In other words, the motor component 4 and the impeller component 1 are formed integrally sharing the lower endwall portions 2 and 12 as a common part. In comparison with the conventional connecting structure between an impeller component and a motor component such as in FIG. 2, the number of components is reduced, which allows the fan motor to be axially downsized. In addition, the weight of the fan motor can be reduced.

The present invention is aimed at cooling efficiently an electronic device that is low-profile and portable, and therefore realizes an impeller component 1 that includes the impeller extending along the rotational axis and that has a cantilever structure so that stable rotation is obtained even at 5000 rpm or higher speeds. An impeller component 1 of the present invention in the dimensions r=6.5 mm and h=23 mm, for example, includes an impeller blade unit 3 in which each blade thereof is made of a plastic resin having a thickness of 0.2 mm. In this case, it would be difficult to secure strength in a structure in which both ends of the impeller are retained by bearings. Furthermore, with these dimensions it is difficult to secure sufficient area for the opening 9 that is the airflow inlet, meaning that sufficient static pressure and cooling efficiency might not be realized. Thus, in order to realize the cooling properties of high static pressure and high efficiency that are characteristic of the present invention, a rotation speed of 5000 rpm or higher is required for the maximum wind speed point to appear. This is because a sufficient ejection airflow B (see FIG. 2) must be generated, since 2r is less than h. In order to hold down to the minimum losses that can occur when the intake airflow A abuts the upper surface of the lower endwall portions 2 and 12, a rotation speed of 10,000 rpm or higher is more preferably required so that the intake airflow A can change to the ejection airflow B efficiently. Thus, a small fan motor having higher static pressure and higher efficiency than conventional fan motors can be realized.

In terms of further practical applications, a fan motor according to the present embodiment of the invention having impeller of dimensions r=5 mm and h=10 mm, for example, and rotated at a speed of 30,000 rpm realizes higher efficiency than is the case with conventional fan motors. The rotation speed n in the present invention is preferably higher than 5000 rpm, more preferably higher than 10,000 rpm.

A fan motor according to the present invention is developed for cooling a portable electronic device or other small device, so it is desirable to use the fan motor at higher rotating speed for obtaining higher cooling efficiency in spite of the small size of the fan. A recommendable rotating speed range in which a fan motor according to the present invention should be used is generally 20,000-30,000 rpm, since requisite conditions that have to be satisfied include motor performance, balance between power consumption and cooling performance, and vibration loss and noise that are smaller than predetermined levels. If a high performance motor that can satisfy these conditions is realized, a fan motor having higher static pressure and higher cooling efficiency will be realized by operating it at a rotation speed higher than 30,000 rpm or 40,000 rpm.

In applications of fan motors according to the present invention operated at such speeds, the diameter 2r of the impeller blade unit is preferably 25 mm or smaller. This is because the thickness of portable electronic devices in which the fan motor is to be embedded is approximately 25 mm in general. In addition, considering cellular-phone or other applications, the diameter should be 12.5 mm or smaller. Of course, characteristics of a fan motor of the present invention can be realized in an impeller blade unit having a larger diameter, for example, 30 mm or 40 mm. With such larger impeller blade-unit diameters, however, rotational speed higher than 5000 rpm or preferably higher than 10,000 rpm is required so that loss due to collision between the intake airflow A and the lower endwall portions 2 and 12 can be avoided; consequently greater load is put on the motor with the increased fan diameter. Although characteristics of a fan of the present invention may be realized by using a high performance motor, it is desirable in terms of practicability to configure the impeller blade unit so that its diameter 2r is equal to or smaller than 12.5 mm so as to reduce the impeller load on the motor. In addition, it is more preferable that the diameter 2r is equal or smaller than 5 mm. Given that the entire axial length of the motor component 4 and the impeller component 1 (the axial distance between the lower end of the bearing 23 and the upper end of the impeller blade unit 3) is represented by k, it is desirable that k be smaller than 100 mm. It is more desirable that k be smaller than 70 mm if the fan impeller is to be embedded in a portable electronic device.

The entire impeller component 1 or a part of the same is preferably made of a liquid crystal polymer, a carbon-fiber-reinforced liquid crystal polymer, a glass-fiber-reinforced liquid crystal polymer, a carbon-fiber and glass-fiber-reinforced liquid crystal polymer, soft iron, stainless steel, aluminum or ceramic. As a result, reduction of weight and downsizing of the impeller component 1 can be realized while securing sufficient rigidity.

As explained above, the present invention realizes a fan motor having high static pressure and high efficiency by rotating at a speed of 5000 rpm or higher a cantilever-type impeller having preferably a diameter 2r of 25 mm or smaller. Detailed simulations and testing on actual devices clarified that the following two conditions must be taken into consideration as preconditions of the high static pressure and high efficiency of a fan motor of the present invention. The FIG. 5 graph plots the results of the simulations and testing. A principle object of this graph is to show tendencies, so for ease of understanding the energy values given along the vertical axis have been normalized concerning the vibration component, the windage loss component, and the product thereof.

A first condition is that the height h of the impeller component is sufficiently large so as to keep the windage loss to a minimum; and consequently the axial length m of the motor is smaller than h. This is because some of the factors considered to cause windage loss include, among other losses, loss due to collision between the intake airflow A and the upper surface of the lower endwall portions 2 and 12, and loss due to increase in the size of eddies in air turbulence, and these factors presumably can be eliminated if m is smaller than h.

A second condition is that h is not larger than necessary for holding rotational vibrations of the impeller and other vibrations to a minimum; and consequently h/2 is smaller than m. This is because rotational and other vibrations in a cantilever-type impeller tend to be generated easily unless the span m of the motor bearing unit is sufficiently larger than the length h of the cantilever portion.

Figure 5:
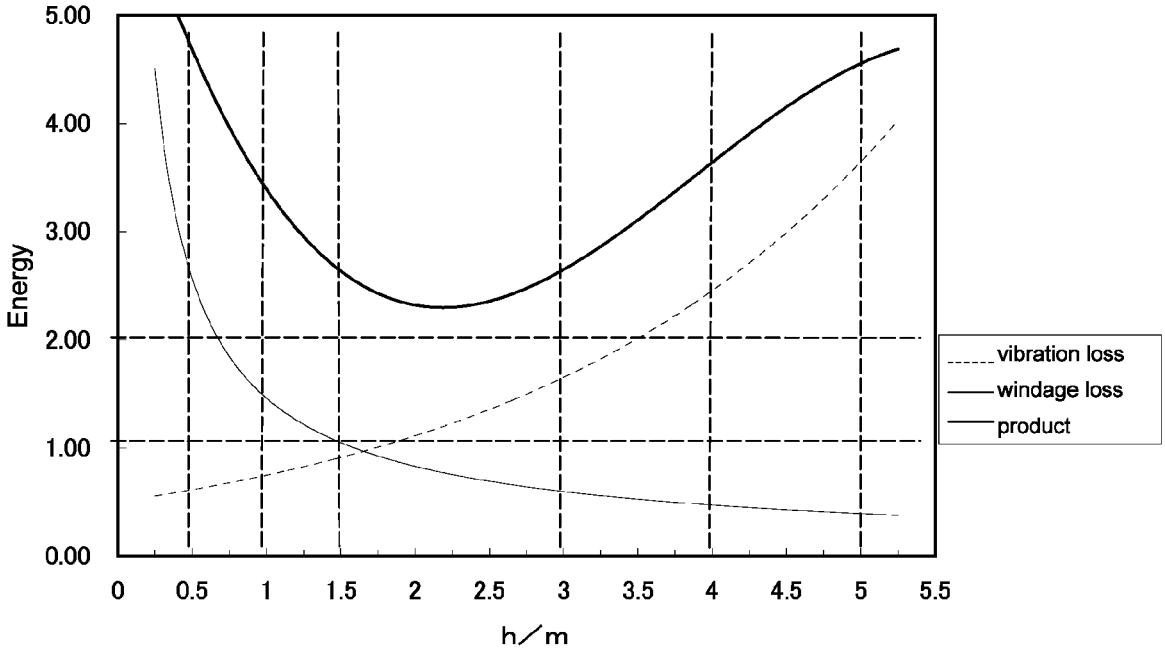
FIG. 5 is a graph plotting a relationship between windage loss and vibration loss.

FIG. 5 shows the results of measuring energy loss due to vibrational loss and energy loss due to windage loss when the ratio (h/m) is altered. In the experiment, the impeller component had dimensions r=6.5 mm, h=23 mm, the rotating speed n was 30,000 rpm, and the bearing unit was constituted by a pair of ceramic ball bearings. However, according to additional measurements made in the present invention, the same results as in FIG. 5 were obtained with a motor using a sliding bearing as well as with a motor using a fluid dynamic pressure bearing, instead of the ball bearing.

When h/m decreases, energy loss due to windage loss increases. It was understood therefore that if the first condition explained above is satisfied—that is, within the range of h/m>0.5, preferably within the range of h/m>1.0, and more preferably within the range of h/m>1.5-energy loss due to windage loss can be reduced sufficiently. On the other hand, with increased h/m, energy loss due to vibrational loss increases. It was understood therefore if the second condition explained above is satisfied—that is, within the range of h/m<5.0, preferably within the range of h/m<4.0, and more preferably within the range of h/m<3.0—energy loss due to vibrational loss can be reduced sufficiently. By changing the geometry of a component or by altering other parameters to satisfy either the first condition or the second condition explained above, a state with sufficiently small energy loss as a whole can be obtained.

In addition, as indicated in FIG. 5, it was found when evaluating energy loss due to vibrational loss and energy loss due to windage loss totally by calculating the product thereof that energy loss becomes sufficiently small within the range of h/m=0.5 to 5.0, becomes more sufficiently small within the range of h/m=1.0 to 4.0, and becomes minimum within the range of h/m=1.5 to 3.0.

Though the above explanation is with regard to a stationary shaft and outer-rotor-type motor, it will be appreciated that a similar structure can be adopted for a rotating shaft and inner-rotor-type motor (not illustrated). In the latter case, the drive force transmission portion 11 that is a cylindrical potion extending downward from the impeller component is replaced with a component (not illustrated) for connecting to the shaft, and the lower endwall portion 2 is fixed not to the outer race 31 but to the inner race 32 of the adjacent bearing.

Figure 6:
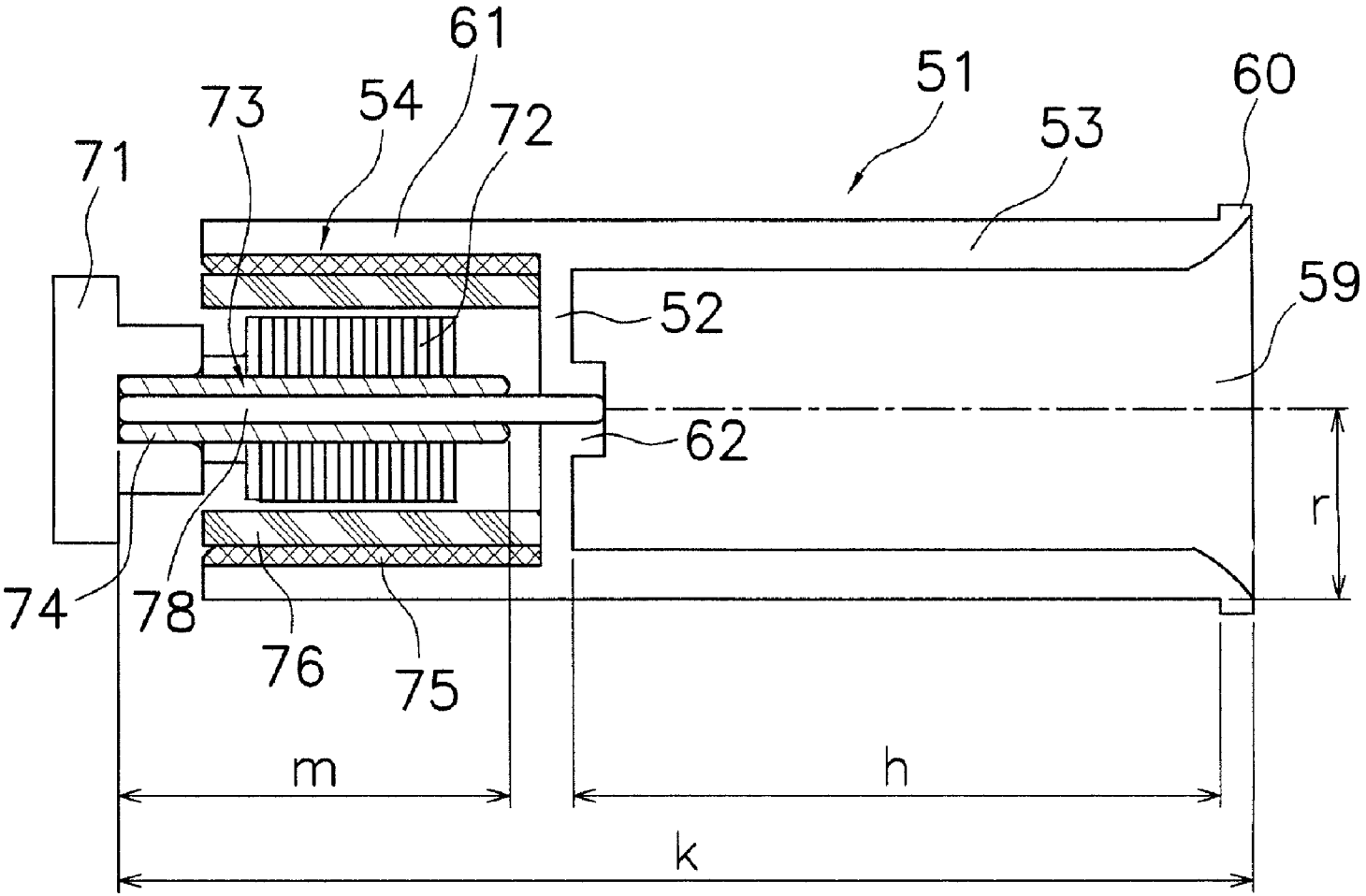
FIG. 6 is a vertical cross section of a fan motor according to still another embodiment of the present invention.

Next, another embodiment of the present invention will be explained with reference to FIG. 6. FIG. 6, in the same way as FIG. 4, shows a cross section, taken along a plane including the rotational axis, of a fan motor having a structure in which the impeller component and the motor component are made integrally. The fan motor of this embodiment is different from the fan motor of the above embodiment in that the bearing portion of the motor component utilizes a sliding bearing or a fluid dynamic pressure bearing instead of a ball bearing.

This fan motor includes an impeller component 51 and a motor component 54. The impeller component 51 and the motor component 54 are disposed axially stacked and connected to each other.

The impeller component 51 is an impeller of the cantilever type used for centrifugal fan motors. The impeller component 51 includes: a drive force transmission portion 61 for receiving drive force from the motor component 54; a lower endwall portion 52 that forms a boundary-wall separation between the motor component 54 and the impeller component 51; a protruding portion 62; and an impeller blade unit 53 having plural blades, each of the blades being fixed at its lower end to the outer margin of the wall surface of the lower endwall portion 52, and each extending along the rotational axis to its upper end. The impeller blade unit 53 is cantilevered, that is, the lower end thereof is fixed to the lower endwall portion 52 while the upper end thereof is not supported by anything. When the impeller component 51 rotates, an airflow is generated streaming along rotational axis through the opening 59 in the upper end of the impeller blade unit 53 and towards the wall surface of the lower endwall portion 52.

The lower endwall portion 52 is an annular section from the circumferential margin of which the impeller blade unit 53 and the drive force transmission portion 61 extend, while inward thereof the protruding portion 62, a discoid section that protrudes axially upward, is provided for fixing and retaining the shaft 78. The impeller component 51 further includes a ring connection portion 60 for joining together the upper end portions of impeller blade unit 53. The drive force transmission portion 61 in this embodiment is an extension, extending from the lower endwall portion 52 along the outer periphery of the motor component 54, and more specifically is an extending cylindrical section that encloses the entire axial length of the outer side of the motor component 54. In this way, the drive force transmission portion 61 has a greater area of contact with the rotary section of the motor component 54, which further improves the rotational stability of the impeller component 51 to reduce vibrational losses. Consequently, the efficiency of the fan motor is further improved. The impeller blade unit 53, the lower endwall portion 52, the protruding portion 62 and the drive force transmission portion 61 are formed integrally so as to constitute an impeller component 1 having a single unit structure.

The motor component 54 has a so-called outer rotor structure in which the rotary section is located along the motor periphery. The rotary section of the motor component 54 includes a rotor holder 75, a rotor magnet 76, and a shaft 78. The rotor magnet 76 is fixed to the inner surface of the rotor holder 75. The rotor holder 75 constitutes part of a magnetic circuit section as a yoke made of a magnetic material. The axial length of the rotor holder 75 is nearly the same as that of the rotor magnet 76, and its axial ends are substantially identical to each other. The shaft 78 on one end is fixed into the center of the lower endwall portion 52 of the impeller component 51, and then extends along the inside of the rotor magnet 76 and rotor holder 75. On the other end of the shaft 78 is the stationary portion of the motor component 54, which includes a stator 72, a bearing sleeve 74, and a bracket 71. The bearing sleeve 74 at its lower end is fixed into the bracket 71, and the entire remainder thereof extends along the inside of the rotor magnet 76 and rotor holder 75. The shaft 78 is disposed within the bearing sleeve 74. A small gap in the radial direction is formed between the outer surface of the shaft 78 and the inner surface of the bearing sleeve 74. This small gap is filled with oil or gas so as to constitute a sliding bearing 73. Dynamic-pressure-generating grooves can be formed on at least one of the gap-defining surfaces so as to constitute a fluid dynamic pressure bearing. Furthermore, the lower-end surface of the shaft 78 can be supported by a point contact on the surface of the bracket 71 in the center. In addition, in order further to secure the connection where the one end of the shaft 78 is fixed to the rotary section, the lower endwall portion 52 may be made of a strong material such as a metal, and the circumferential margin of the lower endwall portion 52 may be fixedly joined to the upper end portion of the rotor holder 75.

The stator 72 is fixed to the circumferential surface of the bearing sleeve 74, and together with the rotor magnet 76, which the stator 72 radially opposes across a gap, forms the magnetic circuit section. Since the lengthwise magnetic center of the stator 72 is located axially below the lengthwise magnetic center of the rotor magnet 76, the rotor magnet 76 is always magnetically forced downward axially. In this way, the rotor magnet 76 is magnetically biased along the rotational axis so as to balance thrust-load supporting force generated between the surface of the bracket 71 at its center and the end surface of the shaft 78. Thus, the impeller component 51 and the rotary section of the motor component 54 are prevented from floating up axially from the stationary section of the motor component 54. This magnetic biasing can be realized by axially displacing the magnetic center of the stator from that of the rotor magnet as explained above, or by disposing in the bracket a magnetic member in a position where it axially opposes the rotor magnet. Alternatively, the biasing force may be realized by arranging magnets on the bracket and the rotary section, with either the like or the opposite poles of the magnets disposed in axial opposition, or may be realized by arranging another magnet and a magnetic member on the bracket and on the rotary section respectively in axially opposing positions, exclusively for generating a biasing force.

The configuration of the connection between the motor component 54 and the impeller component 51 will be explained. The drive force transmission portion 61 of the impeller component 51 is fixed to the rotor holder 75 of the motor component 54 so as to cover the entire peripheral surface of the rotor holder 75. The upper end surface of the rotor holder 75 and the upper end surface of the rotor magnet 76 are fixed to the lower surface of the lower endwall portion 52.

In this way, the lower endwall portion 52 of the impeller component 51 not only functions to stop the axial flow of air in the impeller component 51, but also functions as a wall surface of the motor component 54. In other words, the motor component 54 and the impeller component 51 are formed integrally, with the lower endwall portion 52 as a common wall. This allows the number of components to be reduced and enables the fan motor to be axially downsized, and in addition makes for reduced weight of the fan motor.

Actions and effects similar to the embodiment explained with reference to FIG. 4 can be obtained with a fan motor according to this embodiment. What is more, since this fan motor utilizes a sliding bearing or a fluid dynamic pressure bearing as the motor component bearing, higher impeller rotating speed and lower impeller noise (decrease in vibration and noise) can be realized.

Figure 7:
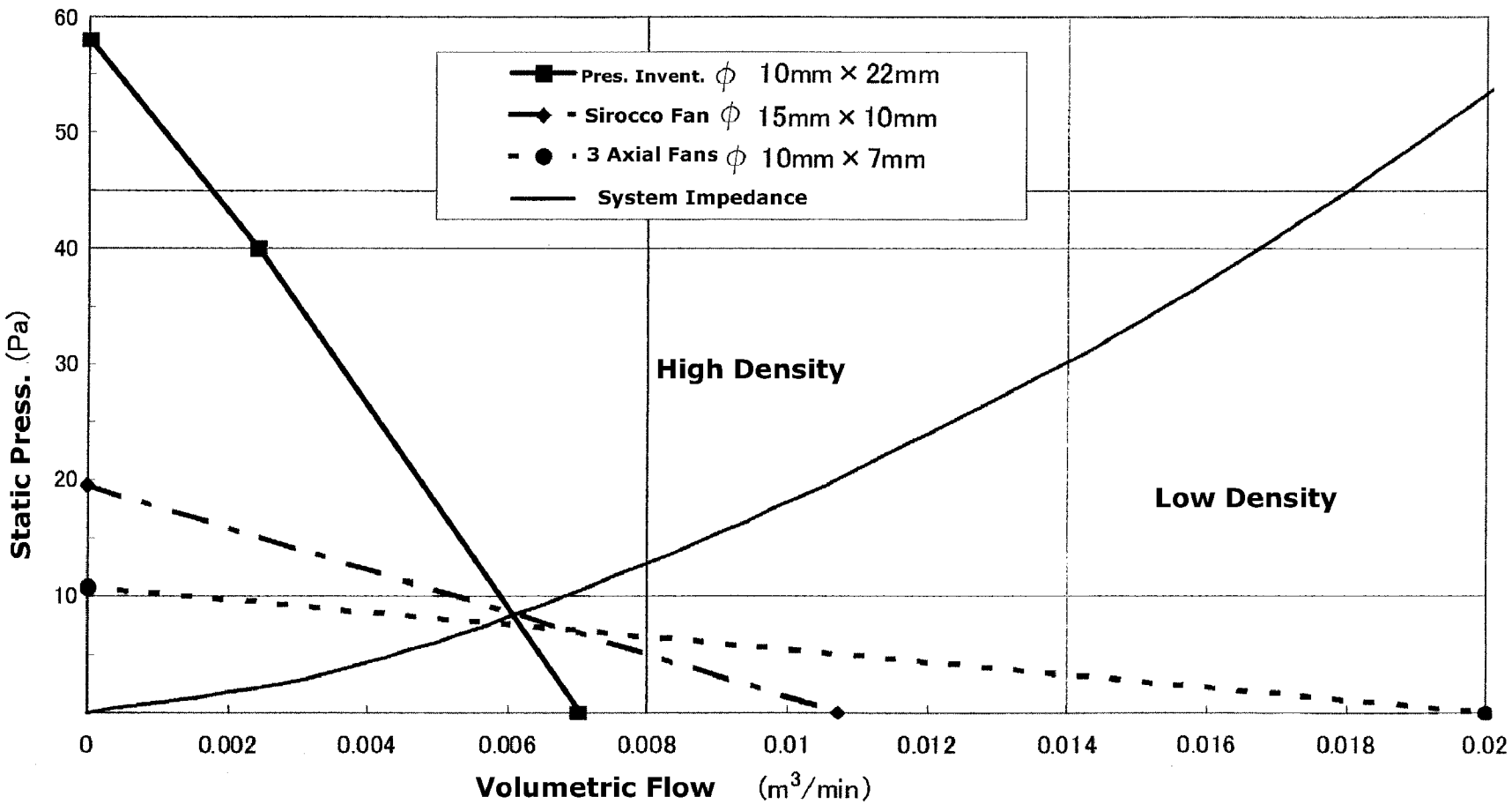
FIG. 7 is a graph comparatively plotting P/Q curves for a fan motor of the present invention and for other fan motors.

Reference is now made to FIG. 7, which is a graph of P/Q characteristics comparing the performance of a fan motor of the present invention with that of a conventional sirocco fan and an axial fan. This graph plots a comparison of P/Q characteristics obtained at respective motor rotational speeds at which each fan motor generated nearly the same level of noise. The fan motor of the present invention included an impeller dimensioned to be 10 mm in diameter and 22 mm in axial length, while the sirocco fan included an impeller dimensioned to be 15 mm on each side and 10 mm in axial length. The axial fan that was also a subject of the comparison had three fan motors including an impeller dimensioned to be 10 mm on each side and 7 mm in axial length, with the fan motors being arranged radially adjoining each other. Each of the fan motors had the same bearing structure (i.e., all of them were ball-bearing), and the volume occupied by the impeller in each of them was equivalent.

As will be understood from FIG. 7, the fan according to the present invention had very high static pressure compared with the conventional fans. A fan motor having a certain P/Q characteristic curve will work at an operation point that is the intersection between the P/Q curve and its system impedance curve, which corresponds to air resistance and airtightness of the object to be cooled by the fan. FIG. 7 shows a most typical system impedance curve, and a cooling target object having a system impedance value above this curve is considered to be of high density. The fan motor according to the present invention was directed to the efficient cooling of compact electronic devices, wherein its cooling target was of very high density. With such high-density cooling targets, the impedance-curve gradient is steeper. Therefore, as will be understood from FIG. 7, a fan having higher static pressure works at higher-position operation points, meaning that the cooling efficiency is higher. From this perspective, according to the present invention, a fan motor having higher static pressure than conventional fans can be realized for cooling high density electronic devices efficiently.

As explained earlier, conventionally employed centrifugal fans utilize a flat impeller having a short axial length for minimizing axial space. In contrast, the present invention was derived by changing the conventional thinking so as to develop a high-efficiency centrifugal fan having a pencil-type impeller that is axially extensive. Thus a cooling fan is realized that is suitable for electronic circuitry in cellular phones or mobile personal computers. The pencil-type centrifugal fan according to the present invention is characterized in that by only providing a small circular air inlet, an airflow, generated by the fan, towards internal electronic circuitry can be produced with maximum efficiency, while the airflow heated by the internal electronic circuitry can be ejected from plural air outlets provided in distributed locations within cellular phones and mobile personal computers. Thus, despite the fact that conventionally it has been difficult to downsize electronic devices because the heat generated by the operation of the electronic circuitry cannot be sufficiently dissipated externally, the present invention makes it possible to provide a sufficient cooling function for an electronic device while saving space. As a result, the electronic device can be further downsized.

Figure 9:
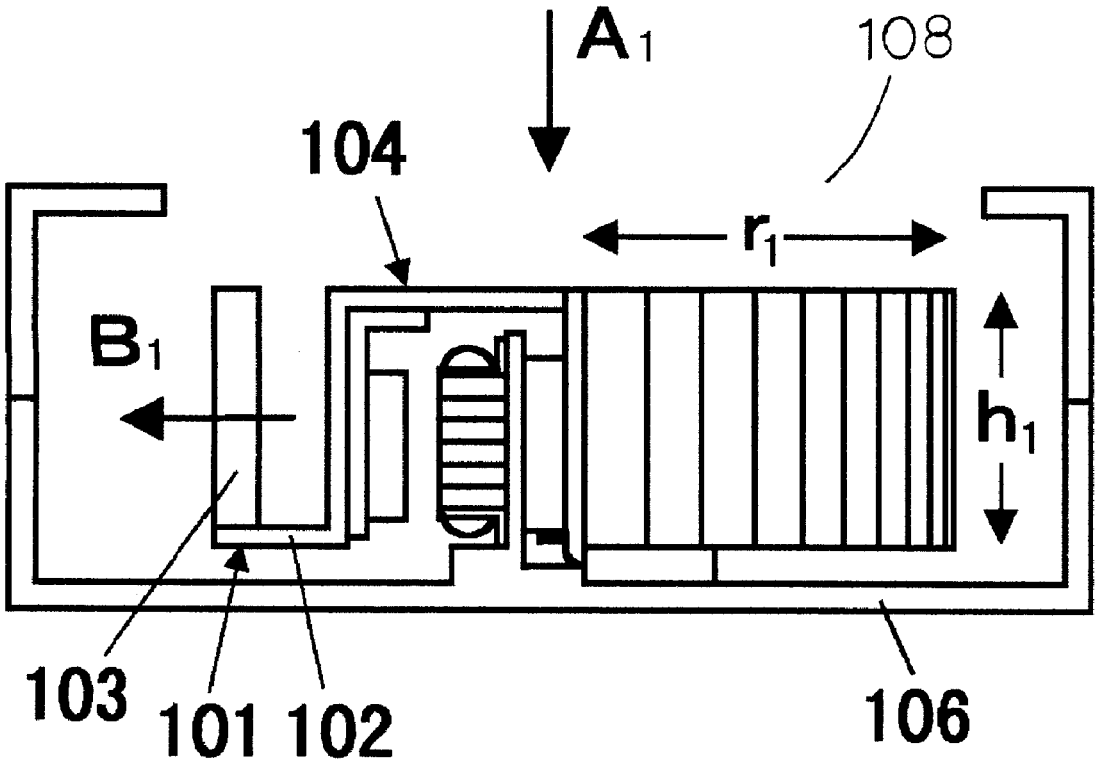
Prior Art FIG. 9
FIG. 9 is a vertical cross section taken along the line $X_1$-$O_1$-$Y_1$-$Z_1$ in FIG. 8.

The present invention is not limited to the embodiments explained above, and within the scope of the present invention various modifications can be made. For example, although the impeller component and the motor component together constituting the fan motor are axially stacked in the above-explained embodiments, it is possible to dispose the motor component to the inside of the impeller component, as with the conventional fan depicted in FIG. 9 (that is, the two components axially overlap entirely or partially).

In addition, the inside corner portion of the impeller blade unit at the upper end along its rotational axis may be beveled partially or entirely in an arc shape or similar arcuately curved form. Arcuately beveling the inside corner portion of the axial upper end of the impeller blade unit enables the intake airflow into the impeller to be smoother, to keep undesired turbulence under control. A fan impeller having good cooling efficiency, and a fan motor utilizing the fan impeller can be realized as a result.

What is claimed is:

1. A centrifugal fan motor for cooling a device, comprising: a motor component having a rotary section, a stationary section and a bearing supporting the rotary section rotatably against the stationary section for rotation about a rotational axis; and an impeller connected to the rotary section, wherein said impeller includes:

a rotational force transmission portion provided on an impeller lower end, for receiving driving force from the motor component;

a lower endwall portion fixed correspondingly to said rotational force transmission portion, for structuring a wall; and an impeller blade unit having plural blades, each of the blades at its lower end being fixed outer-marginally to the upper surface of the lower endwall portion and each of the blades extending axially to its upper end, the blades together defining an opening at an impeller upper end, and rotation of said impeller blade unit therein generating an airflow streaming along the rotational axis through the opening and outward in a radial direction perpendicular to the rotational axis, said impeller blade unit being dimensioned such that given that 2r represents the diameter to the outer circumference of the impeller blade unit, h represents the axial height of the impeller blade unit, and $\alpha$ represents a parameter, the relationships $2\pi rh=\alpha\pi r^2$, $4\leqq\alpha\leqq40$, and $r\leqq12.5$ mm are satisfied.

2. A centrifugal fan motor according to claim 1, wherein the relationship $r\leqq5$ mm is satisfied.

3. A centrifugal fan motor according to claim 1, wherein the relationship $n\geqq5000$ rpm holds, n representing the motor rotational speed.

4. A centrifugal fan motor according to claim 1, wherein the relationship $n\geqq10{,}000$ rpm holds, n representing motor rotational speed.

5. A centrifugal fan motor according to claim 4, wherein said impeller is at least partially made of a liquid crystal polymer, a carbon-fiber-reinforced liquid crystal polymer, a glass-fiber-reinforced liquid crystal polymer, a carbon-fiber and glass-fiber-reinforced liquid crystal polymer, soft iron, stainless steel, aluminum, or ceramic.

6. A centrifugal fan motor according to claim 5, wherein the total length of said motor component and said impeller along the rotational axis is less than 100 mm.

7. A centrifugal fan motor according to claim 5, wherein said bearing includes a pair of axially separated bearing units and the relationship $1.5<h/m<3.0$ holds, m representing the axial separation between said pair of bearing units.

8. A centrifugal fan motor according to claim 5, wherein said bearing includes a pair of axially separated bearing units and the relationship $1.0<h/m<4.0$ holds, m representing the axial separation between said pair of bearing units.

9. A centrifugal fan motor according to claim 5, wherein said bearing includes a pair of axially separated bearing units and the relationship $0.5<h/m<5.0$ holds, m representing the axial separation between said pair of bearing units.

10. A centrifugal fan motor according to claim 5, wherein:

said bearing includes a pair of axially separated bearing units; and the stationary section of said motor component includes a stator having a core unit and coil windings and being disposed axially between said pair of the bearing units.

11. A centrifugal fan motor according to claim 5, wherein the lower endwall portion and a portion of said impeller aligned therewith form an upper wall of said motor component.

12. A centrifugal fan motor according to claim 5, wherein a portion of said impeller aligned with the lower endwall portion forms an upper wall of said motor component.

13. A centrifugal fan motor according to claim 5, wherein said rotational force transmission portion encloses and is fixed to the circumferential surface of said rotor holder.

14. A centrifugal fan motor according to claim 5, wherein said bearing is formed by a slide bearing, and the relationship $1.5<h/m<3.0$ holds, m representing the bearing span axially.

15. A centrifugal fan motor according to claim 5, wherein said bearing is formed by a fluid dynamic bearing, and the relationship $1.5<h/m<3.0$ holds, m representing the bearing span axially.

16. A centrifugal fan motor according to claim 5, wherein said bearing is formed by a slide bearing, and the relationship $1.0<h/m<4.0$ holds, m representing the bearing span axially.

17. A centrifugal fan motor according to claim 5, wherein said bearing is formed by a fluid dynamic bearing, and the relationship $1.0<h/m<4.0$ holds, m representing the bearing span axially.

18. A centrifugal fan motor according to claim 5, wherein said bearing is formed by a slide bearing, and the relationship $0.5<h/m<5.0$ holds, m representing the bearing span axially.

19. A centrifugal fan motor according to claim 5, wherein said bearing is formed by a fluid dynamic bearing, and the relationship $0.5<h/m<5.0$ holds, m representing the bearing span axially.

20. A centrifugal fan motor according to claim 5, wherein:

said bearing is formed by a slide bearing; and the stationary section of said motor component includes a stator having a core and coil windings, both sides of said stator being located within the axial span of said bearing.

21. A centrifugal fan motor according to claim 5, wherein:

said bearing is formed by a fluid dynamic bearing; and the stationary section of said motor component includes a stator having a core and coil windings, both sides of said stator being located within the axial span of said bearing.

22. A cantilever-type impeller that connects with a motor component to form a centrifugal fan motor for cooling portable electronic devices and other small devices, an impeller upper end corresponding to the impeller side of the fan motor and an impeller lower end corresponding to the motor-component side of the fan motor being defined along the impeller rotational axis, the impeller comprising:

a rotational force transmission portion provided on the impeller lower end, for receiving driving force from the motor component;

a lower endwall portion fixed correspondingly to the rotational force transmission portion, the lower endwall portion therein configuring a wall surface; and an impeller blade unit having plural blades, each of the blades at its lower end being fixed outer-marginally to the upper surface of the lower endwall portion and each of the blades extending axially to its upper end, the blades together defining an opening at the impeller upper end, and rotation of said impeller blade unit therein generating an airflow streaming along the rotational axis through the opening and towards said lower endwall on its upper surface, said impeller blade unit being dimensioned such that given that 2r represents the diameter to the outer circumference of the impeller blade unit, h represents the axial height of the impeller blade unit, Z represents the number of blades in the impeller blade unit, d represents the thickness of the blade unit, and β represents a parameter, the relationships $2\pi r\epsilon h=\epsilon\pi r^2$, $3\leqq\beta\leqq30$, $2r\leqq h$, and $r\leqq12.5$ mm, wherein $\epsilon=(2\pi r-Zd)/2\pi r$, are satisfied.

23. A cantilever type impeller according to claim 22, wherein at the upper end opening of said impeller blade unit the blades at their inside corners are beveled at least partially in an arcuate contour.

24. A cantilever type impeller according to claim 22, being at least partially made of a liquid crystal polymer, a carbon-fiber-reinforced liquid crystal polymer, a glass-fiber-reinforced liquid crystal polymer, a carbon-fiber and glass-fiber-reinforced liquid crystal polymer, soft iron, stainless steel, aluminum, or ceramic.

25. A centrifugal fan motor for cooling portable electronic devices and other small devices, the fan motor including an impeller, and a motor component having a rotary section, a stationary section and a bearing, the bearing supporting the rotary section rotatably against the stationary section for rotation about the motor rotational axis, an impeller upper end corresponding to the impeller side of the fan motor and an impeller lower end corresponding to the motor-component side of the fan motor being defined along the motor rotational axis, said impeller connected with the rotary section and comprising:

a rotational force transmission portion provided on the impeller lower end, for receiving driving force from the motor component;

a lower endwall portion fixed correspondingly to said rotational force transmission portion, for structuring a wall; and an impeller blade unit having plural blades, each of the blades at its lower end being fixed outer-marginally to the upper surface of the lower endwall portion and each of the blades extending axially to its upper end, the blades together defining an opening at the impeller upper end, and rotation of said impeller blade unit therein generating an airflow streaming along the rotational axis through the opening and towards said lower endwall on its upper surface, said impeller blade unit being dimensioned such that given that 2r represents the diameter to the outer circumference of the impeller blade unit, h represents the axial height of the impeller blade unit, Z represents the number of blades in the impeller blade unit, d represents the thickness of the blade unit, and β represents a parameter, the relationships $2\pi r\epsilon h=\beta\pi r^2$, $3\leqq\beta\leqq30$, $2r\leqq h$, and $r\leqq12.5$ mm, wherein $\epsilon=(2\pi r-Zd)/2\pi r$, are satisfied.

26. A centrifugal fan motor according to claim 25, wherein the relationship $r\leqq5$ mm is satisfied.

27. A centrifugal fan motor according to claim 25, wherein the relationship $n\leqq5000$ rpm holds, n representing the motor rotational speed.

28. A centrifugal fan motor according to claim 25, wherein the relationship $n\leqq10{,}000$ rpm holds, n representing motor rotational speed.

29. A centrifugal fan motor according to claim 28, wherein said impeller is at least partially made of a liquid crystal polymer, a carbon-fiber-reinforced liquid crystal polymer, a glass-fiber-reinforced liquid crystal polymer, a carbon-fiber and glass-fiber-reinforced liquid crystal polymer, soft iron, stainless steel, aluminum, or ceramic.

30. A centrifugal fan motor according to claim 29, wherein the total length of said motor component and said impeller along the rotational axis is less than 100 mm.

31. A centrifugal fan motor according to claim 29, wherein said bearing includes a pair of axially separated bearing units and the relationship $1.5<h/m<3.0$ holds, m representing the axial separation between said pair of bearing units.

32. A centrifugal fan motor according to claim 29, wherein said bearing includes a pair of axially separated bearing units and the relationship $1.0<h/m<4.0$ holds, m representing the axial separation between said pair of bearing units.

33. A centrifugal fan motor according to claim 29, wherein said bearing includes a pair of axially separated bearing units and the relationship $0.5<h/m<5.0$ holds, m representing the axial separation between said pair of bearing units.

34. A centrifugal fan motor according to claim 29, wherein:

said bearing includes a pair of axially separated bearing units; and the stationary section of said motor component includes a stator having a core unit and coil windings and being disposed axially between said pair of the bearing units.

35. A centrifugal fan motor according to claim 29, wherein the lower endwall portion and a portion of said impeller aligned therewith form an upper wall of said motor component.

36. A centrifugal fan motor according to claim 29, wherein a portion of said impeller aligned with the lower endwall portion forms an upper wall of said motor component.

37. A centrifugal fan motor according to claim 29, wherein said rotational force transmission portion encloses at least part of the circumferential periphery of the rotary section.

38. A centrifugal fan motor according to claim 29, wherein said bearing is formed by a slide bearing, and the relationship $1.5<h/m<3.0$ holds, m representing the bearing span axially.

39. A centrifugal fan motor according to claim 29, wherein said bearing is formed by a fluid dynamic bearing, and the relationship $1.5<h/m<3.0$ holds, m representing the bearing span axially.

40. A centrifugal fan motor according to claim 29, wherein said bearing is formed by a slide bearing, and the relationship $1.0<h/m<4.0$ holds, m representing the bearing span axially.

41. A centrifugal fan motor according to claim 29, wherein said bearing is formed by a fluid dynamic bearing, and the relationship $1.0<h/m<4.0$ holds, m representing the bearing span axially.

42. A centrifugal fan motor according to claim 29, wherein said bearing is formed by a slide bearing, and the relationship $0.5<h/m<5.0$ holds, m representing the bearing span axially.

43. A centrifugal fan motor according to claim 29, wherein said bearing is formed by a fluid dynamic bearing, and the relationship $0.5<h/m<5.0$ holds, m representing the bearing span axially.

44. A centrifugal fan motor according to claim 29, wherein:

said bearing is formed by a slide bearing; and the stationary section of said motor component includes a stator having a core and coil windings, both sides of said stator being located within the axial span of said bearing.

45. A centrifugal fan motor according to claim 29, wherein:

said bearing is formed by a fluid dynamic bearing; and the stationary section of said motor component includes a stator having a core and coil windings, both sides of said stator being located within the axial span of said bearing.

* * * * *